United States Patent [19]

Matsumoto et al.

[11] 4,036,023

[45] July 19, 1977

[54] FLOOD CONTROL SYSTEM FOR A DAM

[75] Inventors: Kuniaki Matsumoto; Junichi Hatakeyama, both of Kokubunji; Masaharu Okamoto, Hitachi, all of Japan

[73] Assignee: Hitachi, Ltd., Japan

[21] Appl. No.: 708,634

[22] Filed: July 26, 1976

[30] Foreign Application Priority Data

Aug. 1, 1975 Japan ..... 50-93099

[51] Int. Cl.[2] ..... E02B 7/40

[52] U.S. Cl. ..... 61/25; 61/22 R; 137/386

[58] Field of Search ..... 61/22–30; 137/386, 392, 399, 409, 426, 41, 87; 73/313

[56] References Cited

U.S. PATENT DOCUMENTS

| | | | |
|---|---|---|---|
| 2,699,652 | 1/1955 | Laszlo | 61/25 |
| 2,746,480 | 5/1956 | Hildyard | 137/386 |
| 3,338,261 | 8/1967 | Bergeson et al. | 137/386 |
| 3,466,872 | 9/1969 | Schimizu | 61/22 R |
| 3,470,902 | 10/1969 | Hackman | 137/386 |
| 3,490,240 | 1/1970 | Preston | 61/.5 |
| 3,922,564 | 11/1975 | Kachuk et al. | 137/392 |

*Primary Examiner*—Dennis L. Taylor
*Attorney, Agent, or Firm*—Craig & Antonelli

[57] ABSTRACT

A flood control system for a dam provides for measuring the actual water level of the dam and for calculating the deviation value between a set reference water level and the actual water level. Proportional-position control over the gate angle is then performed in response to the calculated water deviation level and means is provided for determining the outflow of water to be discharged from the dam in response to the value obtained by this control.

8 Claims, 8 Drawing Figures

| CONTROL TIME | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| WATER LEVEL DEVIATION | 0 | 0 | 1 | 2 | 4 | 6 | 6 | 7 | 7 | 7 | 6 | 5 | 5 | 4 | 3 | 2 | 2 | 1 | 1 | 1 |
| PROPORTIONAL POSITION ACTION | 0 | 0 | 1 | 1 | 1 | 1 | 1 | 1 | 1 | 0 | 0 | -1 | -1 | 0 | -1 | -1 | -1 | -1 | 0 | 0 |
| CONTROLLED STEP NUMBER | 0 | 0 | 1 | 2 | 3 | 4 | 5 | 6 | 7 | 7 | 7 | 6 | 5 | 5 | 4 | 3 | 2 | 1 | 1 | 1 |
| TARGET STEP NUMBER | 0 | 0 | 1 | 2 | 4 | 6 | 6 | 7 | 7 | 7 | 6 | 5 | 5 | 4 | 3 | 2 | 2 | 1 | 1 | 1 |

| CONTROL TIME | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| WATER LEVEL DEVIATION | 13 | 17 | 22 | 24 | 26 | 27 | 26 | 25 | 23 | 19 | 21 | 19 | 18 | 17 | 17 | 16 | 16 | 16 | 15 | 15 |
| STATUS | a | b | c | c | d | d | d | d | c | b | c | b | b | b | b | b | b | b | b | b |
| TIMER 41 | 0 | 1 | 2 | 3 | 4(0) | 1 | 2(0) | 1 | 2 | 3 | 4 | 5(0) | 1 | 2 | 3 | 4 | 5(0) | 1 | 2 | 3 |
| TIMER 42 | 0 | 0 | 1 | 2 | 3(0) | 1 | 2(0) | 1 | 2 | (0) | 1 | (0) | 0 | 0 | 0 | 0 | (0) | 0 | 0 | 0 |
| TIMER 43 | 0 | 0 | 0 | 0 | 1(0) | 1 | 2(0) | 1 | (0) | 0 | 0 | (0) | 0 | 0 | 0 | 0 | (0) | 0 | 0 | 0 |
| INTEGRATION ACTION | | | | | +2 | | +3 | | | | | +1 | | | | | +1 | | | |
| CONTROLLED STEP NUMBER | | | | | 2 | | 5 | | | | | 6 | | | | | 7 | | | |

| CONTROL TIME | 1 | 2 | 3 | 4 | 5 | 6 | 7 | 8 | 9 | 10 | 11 | 12 | 13 | 14 | 15 | 16 | 17 | 18 | 19 |
|---|---|---|---|---|---|---|---|---|---|---|---|---|---|---|---|---|---|---|---|
| STATUS | a | b | b | b | b | c | c | c | c | c | c | b | b | b | b | b | b | b | b |
| TIMER Tb | 0 | 1 | 2 | 3(0) | 1 | 2 | 3(0) | 1 | 2(0) | 1 | 2(0) | 0 | 0 | 0 | 0 | 0 | 1 | 2 | 3(0) |
| TIMER Tc | 0 | 0 | 0 | 0(0) | 0 | 1 | 2(0) | 1 | 2(0) | 1 | 2(0) | 0 | 0 | 0 | 0 | 0 | 0 | 0 | 0(0) |
| INTEGRATION ACTION | | | | -1 | | | -2 | | -2 | | -2 | | | | | | | | -1 |

FLOOD CONTROL SYSTEM FOR A DAM

BACKGROUND OF THE INVENTION

The present invention relates to a flood control system for a dam having a small capacity. The flood control system is provided particularly for a dam such as a sub-dam, a single dam, a main dam, a connective dam of the main dam, etc.

Prior art flood control systems have been constructed on the basis of a combination of the following controls (1) to (9).

1. Preparative Water Flow Control

The water level is previously lowered by way of precaution against an expected flood.

2. Beforehand Water Flow Control

Even if the water level is less than a reference level when the inflow has begun to increase, a certain quantity of the water flow is previously discharged.

3. Constant Water Level Control

The optimum water level is determined in view of the river conservance and the water utilization and the water level is controlled so that it is maintained in a constant permissible region.

4. Constant Water Flow Control

A constant quantity of water is continuously discharged when the inflow exceeds a predetermined quantity.

5. Set Point Control of Gate Angle

The angle of the gate is controlled so that it coincides with the target angle thereof.

6. Outside Control

The gate is controlled in response to the command angle given from the outside, for example, from the water control center.

7. Constant Proportional Control

When the inflow exceeds a reference level, the water is discharged in proportion to the overflow.

8. Variable Proportional Control

The overflow is discharged at a variable rate.

9. Special Rule Control

The water level is collectively controlled in response to information, such as the rainfall on the upstream side of the dam, the water level of the dam on the river, the margin of the pondage, etc.

When such a prior art system is adopted for use with a dam having a small reservoir capacity, the following problems arise:

1. In a dam where the submerged area and the reservoir capacity are small as compared with the catchment area, the water level has the tendancy to abruptly change. Therefore, it is difficult to react promptly enough to maintain the water level within a permissible range.

2. In a dam where the control range of the water level is small as compared with the inflow, for example, where a hydraulic power plant is provided, it is required to maintain the water level at a level near the level of the filled water. Therefore, high control accuracy is required for the control of the water level.

3. According to constraints of dam control, the following rule has been adopted. Under normal conditions, the outflow $Q_c$[m³/s] at any time is defined by the following equation:

$$Q_c = a \cdot Q_{ct} + b$$

$Q_{ct}$[m³/s] represents the outflow for the previous $t$ minutes before the present time, and $a$ and $b$ represent coefficients determined by various parameters of the dam.

In a flood condition, the outflow is restricted so that the outflow never exceeds the inflow and the water level is within the permissible region. Therefore, it is difficult to control the water level so as to satisfy the constraints of the dam control.

SUMMARY OF THE INVENTION

An object of the present invention is to provide a flood control system for a dam which is capable of promptly reacting so as to maintain the water level of the dam within a predetermined range.

Another object of the present invention is to provide a flood control system which is capable of accurately controlling the water level of a dam.

In order to attain such objects, the present invention is characterized by providing a system comprising means for setting a reference water level for the dam, means for measuring the actual water level of the dam, means for calculating the deviation between the reference water level and the actual water level, means for effecting proportional-position control which generates a first control signal proportional to the measured deviation, integration means for generating a second control signal corresponding to the integration result of the measured deviation, differentiation means for generating a third control signal corresponding to the differentiation result of the inflow determined by the measured deviation, means for calculating the outflow to be discharged in response to the sum of the first, second, and third control signals, and means for calculating the angle of gate to produce the required outflow.

DETAILED DESCRIPTION OF THE PREFERRED EMBODIMENT

Figures 1A, 1B:
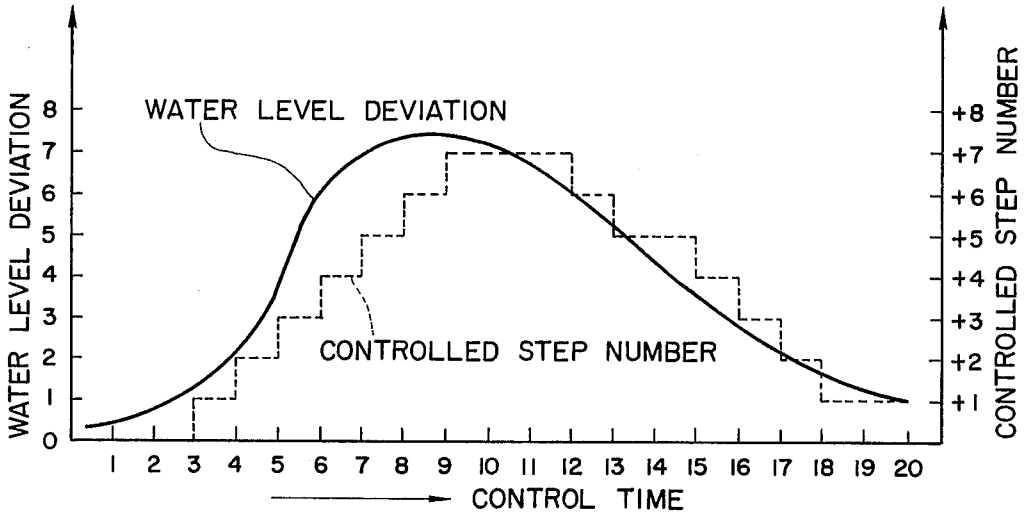
FIGS. 1*a* and 1*b* are diagrams for explaining the proportional-position control according to the present invention.

According to the present invention, a flood control system is realized by the use of proportional-position control, integration control, and differentiation control.

1. Proportional-Position Control

Proportional-position control is designed specifically to function so as to control the water level stably during relatively steady state conditions. When a deviation between the actual water level and the reference water level is detected, an output corresponding to one step of gate angle control is obtained every sampling period so that the water level gradually follows the change of the inflow. One step corresponds to a prescribed amount of outflow discharged during a given sampling period.

2. Integration Control

Integration control functions particularly to eliminate or remove the offset or overshoot control resulting from the proportional-position control under certain conditions of water level deviation. Since the output of one step of gate angle control is obtained every sampling period in accordance with the proportional-position control until the water level is stabilized, follow-up control to such proportional-position action will be generally unsuccessful when the inflow obtained before or after the flood is large. The offset generated by such unsuccessful follow-up control is eliminated, by use of integration control.

3. Differentiation Control

Differentiation control functions so as to smoothly follow up to the reference water level when the water level abruptly changes during flood conditions. During flood conditions, it is difficult to control the water level by means of only the proportional position control and the integration control. Therefore, it is required to additionally control the water level by means of the differentiation control.

The details of such different types of controls are explained below. In this description the terms mentioned are defined as follows:

1. Reference Water level

The reference water level H*o* represents a command or desired water level for the dam. It is desired to maintain this water level at the reference water level even if a flood condition occurs.

2. Water Level Deviation

The water level deviation $\Delta H$ represents the difference between the actual water level H and the reference water level H*o*.

3. Target Step Number

The target step number represents the number of target steps or incremental steps of a given water level deviation and corresponds to the target outflow [$m^3/s$] to be discharged. For example, for a dam of a particular size, one step may correspond to the outflow 0.83 [$m^3/s$]. Furthermore, the target step number corresponds to the water level deviation. For example, when the deviation is 10[cm], the target step number is 10.

4. Controlled Step Number

The controlled step number represents the number of the controlled steps of gate angle adjustment necessary to produce a corresponding outflow to be discharged; in other words, the controlled step number represents the gate angle.

5. Flood Condition

The flood condition represents the conditions where the inflow to the dam is more than a predetermined quantity. For example, it represents the condition where the inflow is more than 100 [$m^3/s$] if the capacity of the dam is 85000 [$m^3$].

6. Control Time

The control time represents the period of time for control. One period of control time is, for example, 20 [s].

As a first step, the proportional-position control will be explained. The proportional-position control occurs when the water level deviation is more than 1 [cm] and is realized in response to the following three conditions:

a. In a case where the water level is ascending:

When the water level deviation is more than 1 [cm], the controlled step number or gate angle is successively increased by one step until the controlled step number coincides with the target step number. The proportional-position control is stopped when the controlled step number coincides with the target step number.

b. In a case where the water level is descending:

The controlled step number or gate angle is successively decreased by one step until the controlled step number coincides with the target step number. In such a case, the controlled step number is 1 even when the target step number becomes zero, because the outflow must not be zero by the constraints of the dam control.

c. In a case where the water level changes from the ascending condition to the descending condition:

The controlled step number increases as shown in above-mentioned paragraph (a) when the water level is ascending. When the controlled step number coincides with the target step number and the outflow balances with the inflow, the proportional-position control is stopped. When the water level further ascends, the action shown in paragraph (a) is again performed. On the other hand, when the outflow exceeds the inflow, the water level begins to decrease. Under such condition, when the controlled step number exceeds the target step number during two successive sampling periods, the action shown in paragraph (b) is performed. Therefore, a dead band corresponding to a sampling period is present when the water level changes from the ascending condition to the descending condition. This dead band is provided to avoid the hunting of the gate operation.

FIGS. 1*a* and 1*b* show an example of the proportional-position control described above. In these drawings, FIG. 1*a* shows the relationship between the water level deviation and the controlled step number at the respective control times. A solid line indicates the water level deviation and a dotted line indicates the controlled step number.

FIG. 1*b* shows numerically the relationship between the water level deviation, the status of the proportion-position action, the controlled step number, and the target step number for each control time. The target step number corresponds to the water level deviation. Numeral 1 in the "proportional-position action" represents the state where the proportional-position control is performed so that the controlled step number is successively increased by one step. Numeral 0 therein represents the state where the proportional-position control is stopped. Numeral −1 represents the state where the proportional-step control is reversed so that the controlled step number decreases by one step.

The proportional-position control described above can be realized by providing a standard function generator which satisfies such relationship between the water level deviation and the controlled step number, as described above.

Next, integration control will be explained in detail. Since the controlled step number changes by one step every sampling period during proportional-position control, an offset is generated when the inflow abruptly increases. The integration control functions to eliminate this offset.

When the water level is ascending, integration control is performed as follows. It is presumed that the control band of the water level is 50[cm].

a. When the water level deviation is in a region from zero to 15[cm], the integration control is stopped.

b. When the condition where a water level deviation of more than 15[cm] is continuously detected for longer than a period T1, the controlled step number increases by one step.

c. When the condition where a water level deviation of more than 20[cm] is continuously detected for longer than a period T2, the controlled step number increases by two steps.

d. When the condition where a water level deviation of more than 25[cm] is continuously detected for longer than a period T3, the controlled step number increases by three steps.

Since the chance of occurrence of a dangerous condition becomes higher as the water level deviation becomes larger, the periods T1, T2, and T3 are determined so as to satisfy the relationship of T1 > T2 > T3. The integration control is performed according to the priority order from condition (d) to condition (a).

Figure 2:
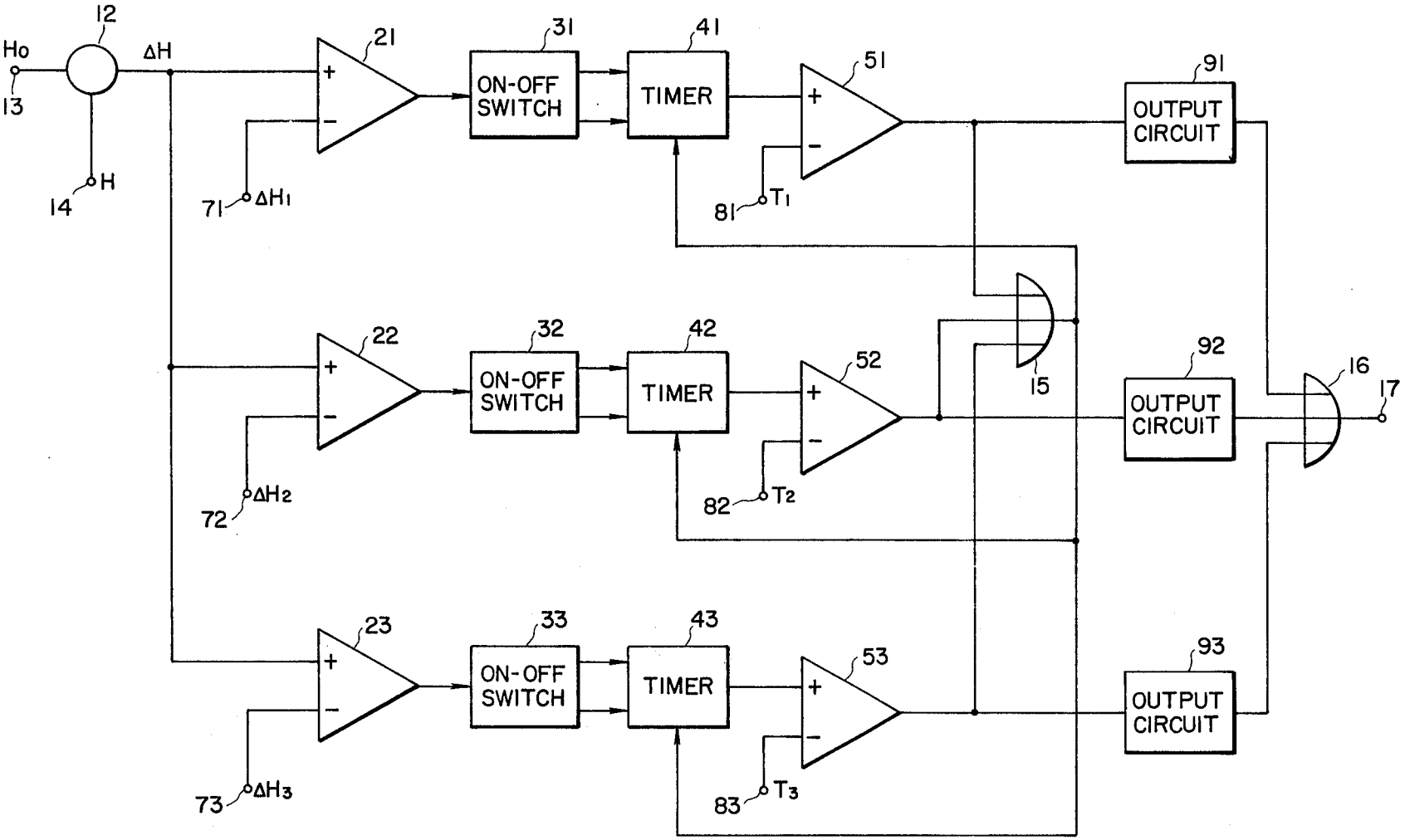
FIG. 2 is a schematic diagram showing an example of a control circuit for effecting integration control according to the present invention.

FIG. 2 shows an example of a circuit for performing the integration action described above. In FIG. 2, a comparator 12 has a first input terminal 13 for receiving a signal corresponding to the reference water level H*o* and a second input terminal 14 for receiving a signal corresponding to the actual water level H. The output of comparator 12, which represents the deviation ΔH, is applied to each of the plus inputs of the differential amplifiers 21 through 23, which receive at their minus inputs 71 through 73 the reference deviation signals ΔH1 through ΔH3, respectively. The outputs of the differential amplifiers 21 through 23 are connected to respective ON-OFF switches which generate set or reset signals in response to the outputs of the differential amplifiers 21 to 23, respectively. Timers 41 to 43 are connected to the ON-OFF switches 31 through 33, respectively, and have their outputs connected to the plus input of a respective one of the differential amplifiers 51 through 53, the minus input terminals 81 through 83 thereof receiving signals representing the time periods T1 to T3, respectively. The outputs of the differential amplifiers 51 through 53 are connected to OR gate 15 whose output is applied in common in control of the timers 41 – 43. Output circuits 91–93 generate signals corresponding to the respective step numbers when the outputs of the differential amplifiers 51 to 53 are applied thereto. The outputs of the circuits 91–93 are applied through OR gate 16 to output terminal 17.

When such a circuit construction, the deviation ΔH between the reference water level H*o* and the actual water level H is obtained by the comparator 12 and is applied to each of the differential amplifiers 21 to 23. Output signals are obtained from one or more of the differential amplifiers 21 to 23 when the deviation ΔH is larger than the reference deviations ΔH1 to ΔH3 respectively applied to these amplifiers. Set signals or reset signals are obtained from the ON-OFF switches 31 to 33, which may take the form of standard monostable circuits, according to whether or not the outputs from the amplifiers 21 to 23 are received. Thus, the timers 41 to 44 will be turned on or off in response to the respective set or reset signals received from the switches 31 to 33.

Output signals are obtained from the differential amplifiers 51 to 53 when the count values of the timers 41 to 43 exceed the set time periods T1 to T3. The timers 41 to 43, which may take the form of conventional step generators producing an increasing stepped output level, are reset by the output of each of the differential amplifiers 51 to 53 via the output of OR gate 15. At the same time, the signals corresponding to the respective step numbers are obtained from the output circuits 91 to 93 when the outputs from the amplifiers 51 to 53 are applied thereto.

A signal corresponding in level to one step is obtained from the output circuit 91 and signals corresponding in level to two and three steps are obtained from the output circuits 92 and 93, respectively. As an example, it may be presumed that the signals ΔH1, ΔH2 and ΔH3 represent reference deviations of 15, 20, and 30[cm], respectively. In such case, when the condition where the water level deviation exceeding 20[cm] continues for the period T2, a signal corresponding in level to two steps is obtained from the output circuit 92. No output is provided from amplifier 53 because the water level deviation does not exceed 30[cm] and no output is received from amplifier 51 because period T2 is shorter than period T1 and timer 41 will be reset by the output of gate 15. All timers 41 to 43 are reset by gate 15 so as to return to the initial condition when an output is received from any one of the amplifiers 51 – 53 ensuring that only one of the output circuits 91 – 93 will be enabled each sampling period.

Figures 3A, 3B:
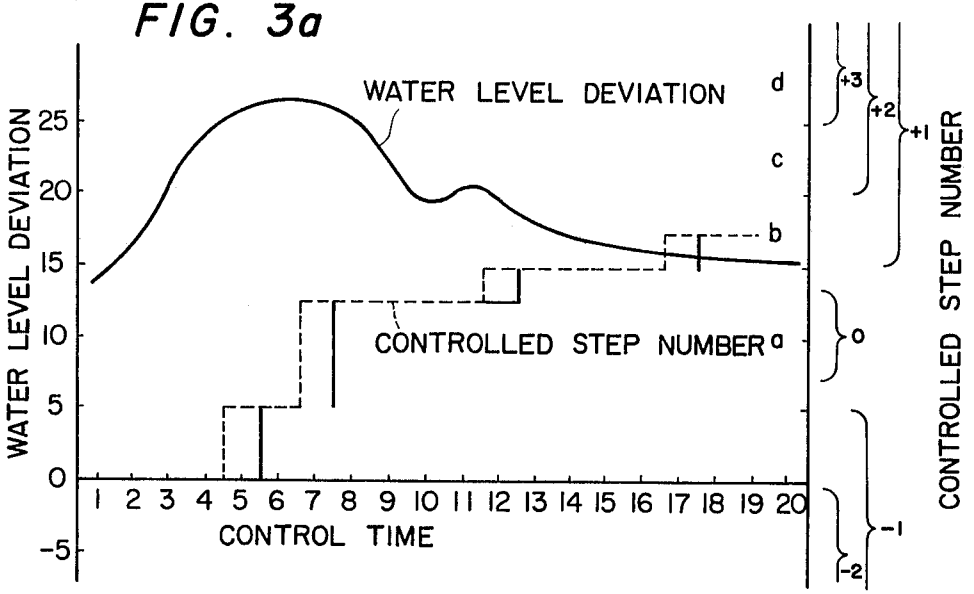
FIGS. 3*a*, 3*b*, 4*a*, and 4*b* are diagrams for explaining the integration control according to the present invention.

FIGS. 3*a* and 3*b* show an example of the integration control for the ascending condition of the water level. FIG. 3*a* shows the relationship between the water level deviation and the controlled step number at the respective control times. The solid line and the dotted line indicate the water level deviation and the controlled step number, respectively.

FIG. 3*b* shows in figures the relationship between the water level deviation, status of the water level corresponding to conditions *a, b, c,* and *d* shown in FIG. 3*a,* count values of the timers 41 to 43, the status of the integration action and the controlled step number for each control time. The parentheses in the count values of the timers 41 to 43 represent the condition where the respective timers are reset. Furthermore, it is assumed that count values corresponding to the set periods T1, T2, and T3 are 5, 3, and 2, respectively.

When the water level is descending, the integration control is performed as follows. The condition where the outflow exceeds the inflow occurs when the excessive flood condition has passed. If such an over-control condition is maintained, the water level becomes less than the reference water level. The integration action functions so that the water level is maintained at the reference water level by gradually closing the gates as the water level comes near the reference water level during descending of the water level.

The integration action during the condition of descending water level functions in response to the following three conditions:

a. When the water level deviation is more than 5[cm], the integration action is stopped.

b. When the condition where the water level deviation is less than 5[cm] continues a period T4, the controlled step number decreases by one step.

c. When the condition where the water level deviation is less than zero continues during a period T5, the controlled step number decreases by two steps. The integration action is performed according to the priority orders from paragraph (c) to paragraph (a). The periods T4 and T5 are determined so as to satisfy the relationship of T4 > T5.

The integration action in the descending condition is realized by providing a circuit including timers T*b* and T*c* in the similar manner to FIG. 2. The timer T*b* is provided for counting the duration of the condition where the water level deviation is less than 5[cm] and the timer T*c* is provided for counting the duration of the condition where the water level deviation is less than 0[cm]. When the count value of timers T*b* or T*c* reaches a predetemined value, for example, 3 or 2, respectively, the integration action functions so that the controlled step number decreases by one or two steps. At the same time, these timers T*b* and T*c* are reset.

Figures 4A, 4B:
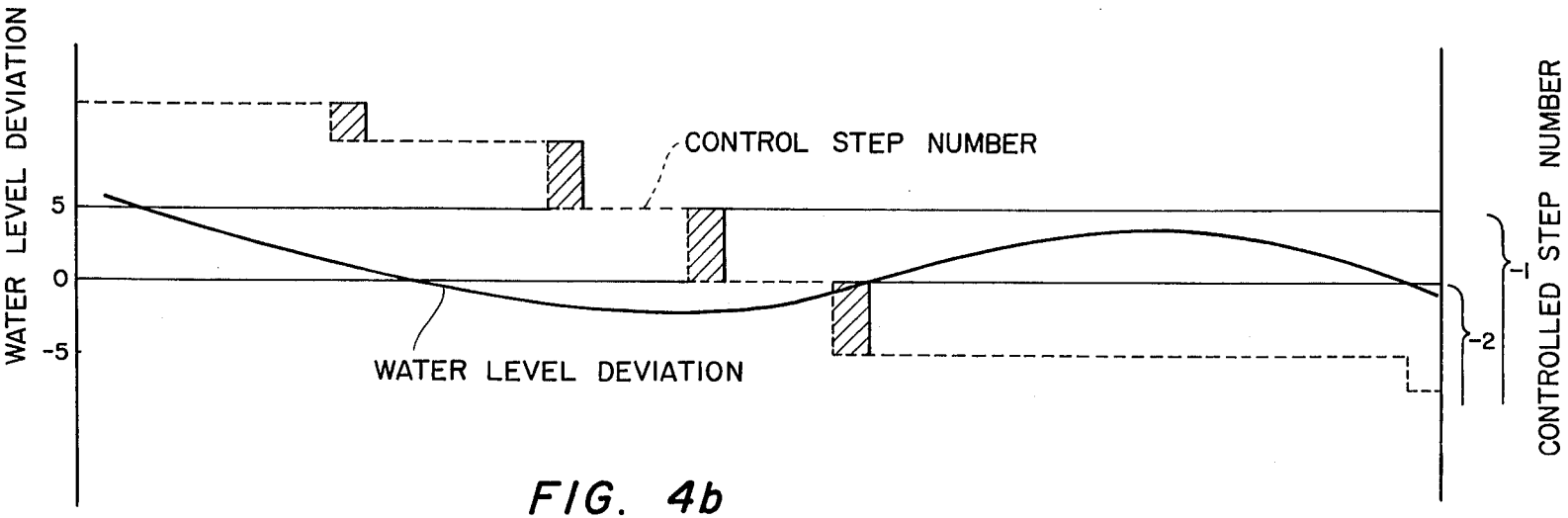

In a case where the water level is less than the reference level, the integration action for the descending condition is performed even if the water level is ascending. FIGS. 4*a* and 4*b* show an example of the integration action for the condition of descending water level. FIG. 4*a* shows the relationship between the water level deviation and the controlled step number at the respective control timers. FIG. 4*b* shows in figures the relationship between the status of the water level deviation, the count values of the timers T*b* and T*c*, and the status of the integration action for each control time. The status, *a, b,* and *c* corresponds to the level *a, b,* and *c* of the water level deviation. Since the water level is ascending and the deviation is more than zero during the control times 12 to 16, the integration action for the descending condition is not performed.

The differentiation action functions so as to respond to the change of the water level caused by the radical change of the inflow during flood conditions.

Since there is not restriction for the outflow during the flood period, the water level theoretically is maintained at a constant value if the outflow is equalized to the inflow. However, since the outflow is obtained according to the change of the inflow during a predetermined period, the control is delayed in a dam having a small capacity. Furthermore, under conditions, the inflow changes vibrantly. However, it is undesirable to frequently change the angle of the gate in response to the change of the water level in view of the limitations of the gate device.

In view of such a problem, the differentiation action is performed in response to the change in condition and the change quantity of the inflow.

There are the following two methods (1) and (2) for performing the differentiation action:

1. The differentiation action is performed so that small changes of water level are ignored in order to prevent the control function from following these small changes, that is, to respond to oscillation of the water level.

According to the differentiation action, the difference ΔQ between the inflow Q1 at present time *i* and the inflow Q*i* at a previous time *to* before the present time is used for the control. Such difference ΔQ is represented by the following equation $$\Delta Q = Qi - Qi - to \qquad [m^3/s]$$

The inflow *Qi* is obtained by the following equation.

$$Qi = \frac{V(Hi) - V(Hi\text{-}1)}{\Delta T} + q_{i-1} \qquad [m^3/s]$$

In this equation, *Hi* and *Hi*−1 indicate the water levels at the present time *i* and time *i*−1 at one past sampling time, respectively, *V*(*H*) a function showing the relationship between the water level and the pondage, Δ*T* one sampling period and $q_{i-1}$ the outflow at the time *i*−1. The following Table 1 shows an example of the control value corresponding to the change ΔQ of the inflow.

TABLE 1

| change of inflow ΔQ [m³/s] | controlled step number | change of outflow [m³/s] |
|---|---|---|
| more than +150 | +25 | 20.75 |
| +100 to +150 | +15 | 12.45 |
| +50 to +100 | +10 | 8.30 |
| +20 to +50 | + 5 | 4.15 |
| +5 to +20 | + 2 | 1.66 |
| 0 to +5 | 0 | 0 |
| −5 to 0 | 0 | 0 |
| −20 to −5 | − 1 | −0.83 |
| −50 to −20 | − 2 | −1.66 |
| −100 to −50 | − 5 | −4.15 |
| −150 to −100 | − 7 | −5.84 |
| less than −150 | −12 | −9.96 |

In the Table 1 the controlled step number in the descending condition of the inflow is a half of the controlled step number in the ascending condition of the inflow because the control is easily performed in the descending condition due to the relatively slow change of the inflow and it is necessary to give a margin to the angle of the gate when flood conditions repeatedly occur.

In order to realize the differentiation action described above, function generators can be used. First, a function generator is provided for generating the inflow corresponding to the water level and a second function generator is provided for generating the controlled step number corresponding to the change of the inflow.

2. The differentiation action is performed by using the mean value of the inflow at several sampling times. In response to the mean inflow $QI_1$ between the present time and the period of 120 seconds before the present time (during N sampling time band before the present time) and the mean inflow $QI_2$ between the past period of 120 seconds and a past period of 240 seconds before the present time, the step number DS of the differentiation control is obtained as follows.

$$\Delta QI = QI_1 - QI_2 \qquad [m^3/s]$$
$$QF = \Delta QI/N\text{--}1 \qquad [m^3/s]$$
$$DS = QF/N$$

In these equations, Δ*QI* indicates the change quantity of the inflow; *QF* the outflow and *N* and number of samplings for obtaining the mean inflow. The mean inflow $QI_1$ and $QI_2$ is obtained by the following equations.

$$QI_1 = \frac{\sum_{j=0}^{N-1} QIN_{i-j}}{N}$$

$$QI_2 = \frac{\sum_{j=0}^{N-1} QIN_{i-N-j}}{N}$$

In the equations, *QIN* 1 indicates the inflow at a sampling time 1.

Figure 5:
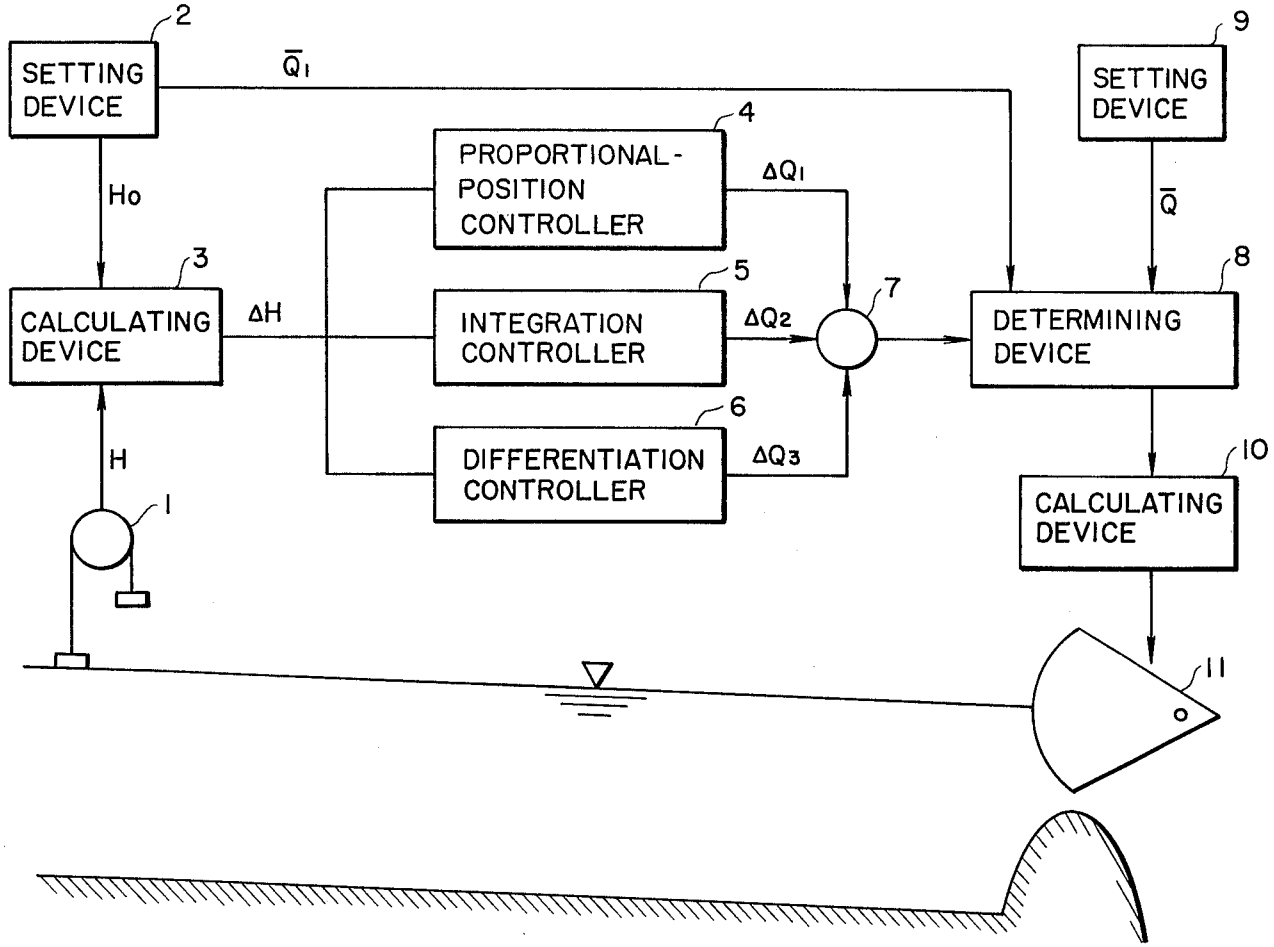
FIG. 5 is a schematic block diagram shown an embodiment of a flood control system according to the present invention.

FIG. 5 shows an embodiment of a flood control system for controlling the water level by means of proportional-position control, integration control, and differentiation control, such as described above.

In FIG. 5 numeral 1 indicates a water level meter for measuring the actual water level H and numeral 2 indicates a setting device for setting the reference water level H*o* and the maximum outflow $\overline{Q}_1$. A calculating device 3 is provided for calculating the water level deviation ΔH between the actual water level H and the reference water level H*o*. To the output of calculating device 3 there is connected a proportional-position controller 4 for performing the proportional-position action, an integration controller 5 for performing the integration action, and a differentiation controller 6 for performing the differentiation action. The outputs of the controllers 4, 5, and 6 are applied to an adder 7 which sums the respective outputs $\Delta Q_1$, $\Delta Q_2$, and $\Delta Q_3$ and applied to result to a determining device 8 for determining the outflow to be controlled. A setting device 9 for setting the maximum outflow $\overline{Q}$ is also connected to the determining device 8, whose output is connected to a calculating device 10 for calculating the angle of the gate 11 corresponding to the outflow determined by the device 8. The reference water level H*o* and the maximum outflow $\overline{Q}_1$ are set as based on the constraints of the dam control and the maximum outflow $\overline{Q}$ is set as based on the discharge capability of the gate 11.

With a system of such construction, the water level deviation $\Delta H$ is calculated by the calculating device and is applied to the proportional-position controller 4, the integration controller 5, and the differentiation controller 6. In these controllers 4 to 6, the proportional-position action, the integration action and the differentiation action are realized in the same manner as described above. For example, the integration controller 5 can be constructed in accordance with the circuit as shown in FIG. 2.

The outflow $\Delta Q_1$, $\Delta Q_2$, and $\Delta Q_3$ corresponding to the controlled step number is obtained from the controllers 4, 5, and 6 and is added by the adder 7. In the determining device 8, the output $$\sum_{i=1}^{3} \Delta Qi$$

of the adder 7 is determined as the outflow to be controlled if the following relationship is satisfied:

$$\sum_{i=1}^{3} \Delta Qi \leqq \overline{Q}_1 \text{ or } \overline{Q}$$

If the output of the adder 7 exceeds the maximum outflow $\overline{Q}_1$ or $\overline{Q}$, the outflow is set to the maximum value $\overline{Q}_1$ or $\overline{Q}$. The gate angle is calculated by the calculating device 10 in response to the outflow determined by the determining device 8. The gate 11 is controlled in response to the gate angle from the device 10.

According to the present invention, the following advantages are realized.

1. It is possible to transfer smoothly from the constant water level control for normal conditions to flood control, without the preparative water flow control which previously lowers the water level by way of precaution against an expected flood.

2. The constant water level control in the prior art system is equal to the control of only proportional-position action. On the other hand, the constant water level control according to the present invention has a function for eliminating the offset by means of the integration action, thereby maintaining accurately the water level at a desired value.

3. Since the control value in the differentiation action is determined in response to the change condition of the inflow (water level), the differentiation action has a similar function to the prediction control.

Therefore, when the inflow abruptly changes in response to the rising water level condition of a flood, the outflow is early controlled.

While we have shown and described an embodiment in accordance with the present invention, it is understood that the same is not limited thereto but is susceptible of numerous changes and modifications as known to a person skilled in the art, and we therefore do not wish to be limited to the details shown and describe herein but intend to cover all such changes and modifications as are obvious to one of ordinary skill in the art.

What is claimed is:

1. A flood control system for a dam having a gate for controlling the water outflow therefrom comprising:

first means for setting a reference water level;

second means for measuring the actual water level;

third means responsive to said first and second means for generating a deviation signal corresponding to the water level deviation between the set reference water level and the measured actual water level;

proportional-position control means for generating a first control signal proportional to said deviation signal generated by said third means;

integration control means for generating a second control signal corresponding to the integration result of said deviation signal generated by said third means;

differentiation control means for generating a third control signal corresponding to the differentiation result of said deviation signal generated by said third means; and fourth means for determining the outflow to be discharged from said dam in response to the sum of said first, second, and third control signals.

2. A flood control system for a dam according to claim 1, which further includes fifth means for controlling the angle of opening of said gate in response to the value of the outflow determined by said fourth means.

3. A flood control system for a dam according to claim 1, which further includes fifth means for providing a signal corresponding to the maximum permitted outflow of water from said dam, and in which said fourth means includes adding means for generating a signal corresponding to the sum of the first, second, and third control signals and determining means for determining the outflow to be discharged from said dam in response to the output signal from said adding means and the maximum outflow signal from said fifth means.

4. A flood control system for a dam according to claim 3, which further includes sixth means for controlling the angle of opening of said gate in response to the value of the outflow determined by said fourth means.

5. A flood control system for a dam according to claim 1, wherein said integration control means includes a plurality of individual integration channels each responsive to a different range of values of said deviation signal for integrating said deviation signal over different time periods.

6. A flood control system for a dam according to claim 5, wherein each integration channel includes comparing means for comparing said deviation signal to a predetermined reference signal, timing means for generating an output representative of elapsed time, switch means responsive to said comparing means for enabling said timing means when said deviation signal exceeds said reference signal, and output means for generating said second control signal when said timer output exceeds a preset time period.

7. A flood control system for a dam according to claim 6, wherein said integration control means further includes means responsive to an output from one integration channel for resetting the timer means in each of the other integration channels.

8. A flood control system for a dam according to claim 7, which further includes fifth means for providing a signal corresponding to the maximum permitted outflow of water from said dam, and in which fourth means includes adding means for generating a signal corresponding to the sum of the first, second, and third control signals and determining means for determining the outflow to be discharged from said dam in response to the output signal from said adding means and the maximum outflow signal from said fifth means.

* * * * *